US006273361B1

(12) United States Patent
Flores et al.

(10) Patent No.: US 6,273,361 B1
(45) **Date of Patent: *Aug. 14, 2001**

(54) PACKING AND STOWING SYSTEM OF ELECTRIC AUTOMOTIVE CONDUCTORS

(75) Inventors: Clemente Lavie Flores; Carlos Tenorio Gutierrez; Silverio Gonzalez Lopez, all of Querétaro (MX)

(73) Assignee: Servicios Condumex S.A. de C.V., Queretaro (MX)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/084,231

(22) Filed: May 26, 1998

(30) Foreign Application Priority Data

May 30, 1997 (MX) ..... 973997

(51) Int. Cl.[7] ..... B65H 16/04

(52) U.S. Cl. ..... 242/597.7; 242/118.32; 242/130; 242/130.2; 242/134; 242/139; 242/594.4; 242/294.6; 206/389; 206/395; 206/415

(58) Field of Search ..... 242/118.3, 118.32, 242/129, 130, 130.2, 130.3, 134, 137, 139, 594.3, 594.4, 594.5, 594.6, 597.7, 127; 206/389, 395, 396, 397, 413, 415

(56) References Cited

U.S. PATENT DOCUMENTS

| | | | | |
|---|---|---|---|---|
| 235,196 | * | 12/1880 | Ball | 242/118.32 |
| 995,801 | * | 6/1911 | Mossberg | 242/118.32 |
| 1,269,003 | * | 6/1918 | Riggs | 242/608.7 |
| 1,599,271 | * | 9/1926 | Baxenden | 242/610.1 |
| 1,966,247 | * | 7/1934 | Janssen | 242/130.3 |
| 2,155,312 | * | 4/1939 | Houtzaager | 206/415 |
| 2,297,667 | * | 9/1942 | Winslow | 242/130.3 |
| 2,381,869 | * | 8/1945 | Amrhein et al. | 242/118.32 |
| 2,409,384 | * | 10/1946 | Peterson | 242/129 |
| 2,497,574 | * | 2/1950 | Bahnson | 242/130.3 |
| 2,646,233 | * | 7/1953 | Gazet | 242/129 |
| 2,695,139 | * | 11/1954 | Horvath | 242/587.2 |
| 2,883,045 | * | 4/1959 | Abramson | 206/396 |
| 2,943,732 | * | 7/1960 | Kovaleski et al. | 242/129 |
| 3,021,010 | * | 2/1962 | McMasters | 242/129 |
| 3,109,540 | * | 11/1963 | Klimpl | 242/129 |
| 3,127,127 | * | 3/1964 | Kohn et al. | 242/129 |
| 3,139,986 | * | 7/1964 | Strock | 242/129 |
| 3,255,889 | * | 6/1966 | Goldman et al. | 242/118.3 |
| 3,292,877 | * | 12/1966 | McMasters | 242/129 |
| 3,446,419 | * | 5/1969 | Mueller | 206/396 |
| 3,690,585 | * | 9/1972 | Lesavoy | 242/130 |
| 3,827,654 | * | 8/1974 | Armstrong | 242/134 |
| 3,937,414 | * | 2/1976 | Bank et al. | 242/129 |
| 3,989,205 | * | 11/1976 | Jabobszoon | 242/129 |
| 4,018,401 | * | 4/1977 | Cunningham | 242/118.3 |
| 4,106,723 | * | 8/1978 | Couture | 242/130 |
| 4,248,391 | * | 2/1981 | Ness | 242/134 |
| 4,293,103 | * | 10/1981 | Tsukamoto | 242/362 |
| 4,456,197 | * | 6/1984 | Canetta | 242/130.4 |
| 4,513,864 | * | 4/1985 | Liebel | 206/396 |
| 4,516,892 | * | 5/1985 | Curro, Jr. | 206/413 |
| 4,552,321 | * | 11/1985 | Raeckelboom | 242/130 |
| 4,763,854 | * | 8/1988 | Borowski | 242/129 |
| 4,811,917 | * | 3/1989 | Nielsen et al. | 242/118.1 |
| 4,821,880 | * | 4/1989 | Ditton | 206/389 |

(List continued on next page.)

*Primary Examiner*—William A. Rivera

(57) ABSTRACT

The packing and stowing system of roll of automotive electric conductors is characterized by three independent sections that when adjusted, they form a back up cover that prevents the deformation of the cable during its winding and when it is being stowed. The sections are integrated by a cylindrical body that is opened when it is introduced in a bobbin, as guide and subjection element of the wound roll; and a post set on a base as support for the piling up of the packed rolls and the hoop of the platform.

11 Claims, 5 Drawing Sheets

U.S. PATENT DOCUMENTS 4,911,299 * 3/1990 Peeters ..... 206/415
4,928,903 * 5/1990 Wirtz et al. ..... 242/130
4,995,512 * 2/1991 Liebel ..... 206/396
4,998,619 * 3/1991 Sowa et al. ..... 242/130.2
5,078,269 * 1/1992 Dekko et al. ..... 206/397
5,078,332 * 1/1992 Carter ..... 242/129
5,170,961 * 12/1992 Bolz et al. ..... 242/586
5,238,113 * 8/1993 Parrott et al. ..... 206/395
5,509,620 * 4/1996 Crews ..... 206/396

* cited by examiner

PACKING AND STOWING SYSTEM OF ELECTRIC AUTOMOTIVE CONDUCTORS

BACKGROUND OF THE INVENTION

The automotive industry seeks to have every time smaller inventories. One way to enhance this is by minimizing the presentation of the product, the automotive cable packing has evolved to contain a smaller quantity of cable and of packing material that can be a source of ecological pollution.

Other even simpler systems of packing and stowing are known for automotive cable packing through a simple hoop of cable rolls and piled up on a platform or stowage. Nevertheless, this kind of stowage is not recommended because the roll weight itself provokes the lose of its form and the tendency to spread on its sides, deforming the roll with the weight of other rolls when they are piled up.

The system object of the present invention allows to offer the users 10 times smaller amounts of product comparing to the packing normally used for automotive cable (30-inch high drums). The packing and stowing system also permits up to 100% savings of storage space. Thus, the distribution costs are lower, up to 40% more can be packed compared to the packing of common drums.

DETAILED DESCRIPTION OF THE INVENTION

Hereinafter, The invention will be described according to the drawings of the FIGS. 1 to 4 where:

FIG. 1. sheet(1) which is joined at its ends to form a cylindrical body , and the FIG. 2B corresponds to a laminate circular section segmented into two annular sections.

FIG. 2. shows a top view of the packing with the roll of hoop cable 2.1 and a lateral view 2.2 of the packed roll 2.1.

FIG. 3. shows a front view of a post to pile up the rolls of packed cable.

FIG. 4. shows an isometric view of the stowing of the packed rolls and grouped on a shipment platform.

The object of this invention is to provide a type of packing for automotive cable in order to reduce the inventories in process, that is: In the area of the automotive cable products there exists a great variety of packing and this one is this the smallest of all, so the inventory in process is minimized, given the great variety of cables that form the car circuits.

A further object of this invention is to permit a space reduction. The size of the packing allows a space reduction for each of the packing included in process, as in each work station a complete set of cables is required for the cut and application of terminal for each one of the electric circuits of the car.

Hereinafter, the, characteristics of the invention are shown as well as the equipment to produce the packing.

Equipment.

Roller NOKIA EKP 450
Collapsible Bobbins
Semiautomatic hoop
Packing material

Detail of the Invention

The way packing and handling in the plant of cables, thermo-fixed automotive primary cable rolls was invented, with the following dimensions:

Interior diameter 20 cm
Exterior diameter 30 cm
Height 10 cm

Characteristics 4 plastic hoops joined by temperature application
Cylindrical cardboard insole to give consistency to the winding of the material.
Round cardboard insole for the roll basis to avoid damages in the material during its handing, storage and cutting
Nucleus of cylindrical cardboard to transport it, stack it and store it, making sure of maintaining the original dimensions.
Approximated weight of the roll with the cable 10 Kg.

The packing and stowing system consists of a winding of automotive cable in a roll form. Depending on the product, its length varies proportionally to its weight for kilometer factor, so the total weight of the roll is 10 kilograms, because the roll dimensions remain constant independently of the product.

Given the weight of the packing, it is easy to manage it manually without sophisticated systems of material managing, because the roll of cable weighs 10 kilograms and it is completely stacked using the post for roll stowing of a maximum of packings.

Because of the great variety of cables required for the manufacturing of automotive electric harnesses, it is necessary to minimize the preparation time for changing the product in the cable cutters. If the packing is smaller and more manageable, a greater variety of products can be prepared and available in the areas where this activity is done.

The main characteristics of the packing of the automotive cable are its capacity and dimensions of the roll and the case to pile up. Since the capacities of other kinds of packing are greater they require equipment for their handling.

Figure 1:
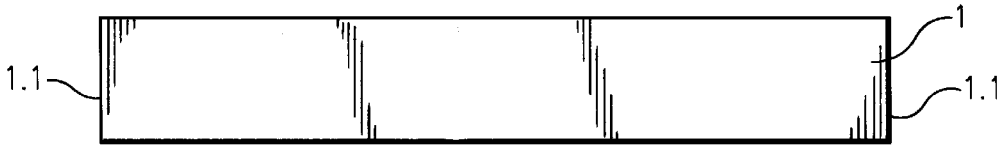
Figure 2B:
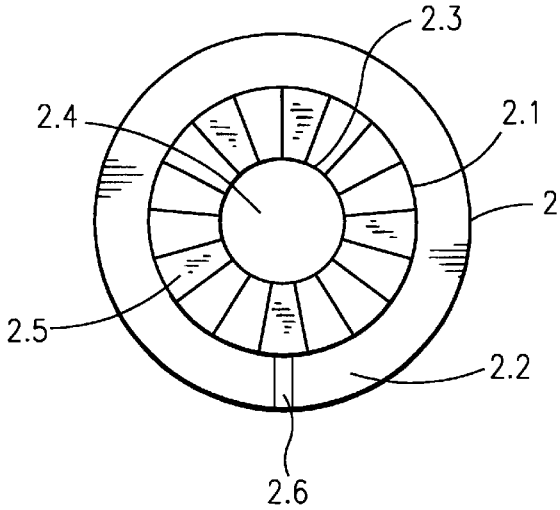
Figure 2A:
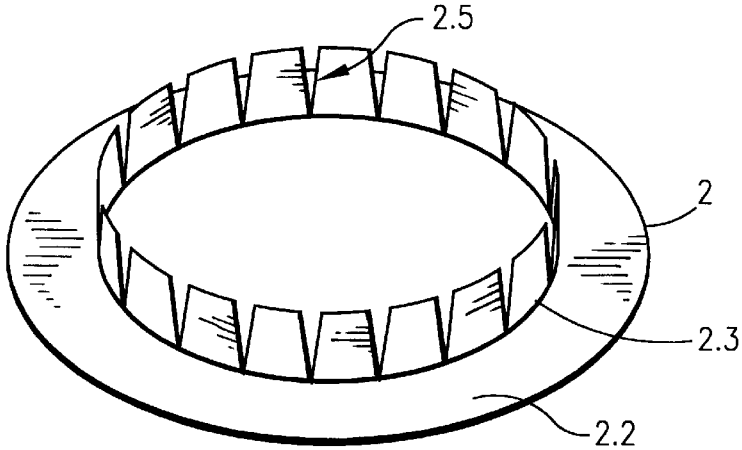

According to the drawings, the packing of the invention is practically constituted of three modular sections:

The first section comprises a cylindrical body 1 integrated with a circular base 2. The cylindrical body 1 is preferably a one mm. thick rectangular sheet as shown in FIG. 1, which is joined on its ends 1.1 to form the cylindrical body shown in FIG. 1A. The cylindrical body has an interior diameter of approximately 20 cm. and a height of approximately 10 cm. The circular base 2 as shown as part of FIG. 1, is concentrically segmented with an outer diameter of approximately 30 cm. The circular base 2 is concentrically segmented at periphery 2.1 forming two sections, an external section 2.2 drawn in a horizontal plane and an internal section 2.3 having two positions, one position in plane with the external section 2.2 and a second position, disposed vertically at 900 relative to the external section 2.2. The outermost diameter a of the external section 2.2 is approximately 30 cm. as stated above. The external section's inner diameter b is the same as the outer diameter of the internal section 2.3, and hence will be identified with the same letter b. The internal section 2.3 has an inner diameter c concentric to the outer diameter b forming a ring cut 2.4 as shown in FIG. 2B. The section between the outer diameter b and the inner diameter c are transversally cut equidistantly from the periphery 2.1 forming attachment wings 2.5 to hold the roll of automotive cable. Initially, the internal section 2.3 is horizontally in the same plane as the external section 2.2 as shown in FIG. 2B. When the circular base 2 is introduced or inserted into a conventional bobbin, a cylinder upon which the cable is wound, the internal section 2.3 opens up to accomodate the bobbin and in this position, the attachment wings 2.5 assumes the vertical position, approximately 900 relative to the external section 2.2 as shown in FIG. 2A. The attachment wings at this position, guides and accomodate the cable, preventing the loss of form of the roll.

The cylindrical body 1 is peripherally wrapped around the center of the roll of cable 2.7 and is adjusted to conform with the inner diameter of the roll once the roll of cable has been wound. The attachment wings together with the cylindrical body 1, at this position, guide and accomodate a pre-wound cable, preventing the loss of form of the roll.

Figure 2:
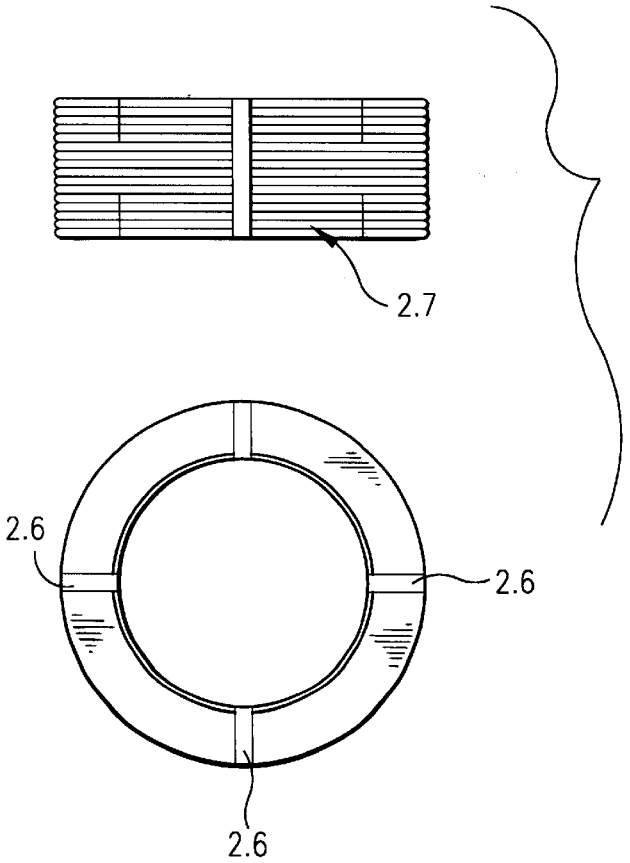
Figure 3:
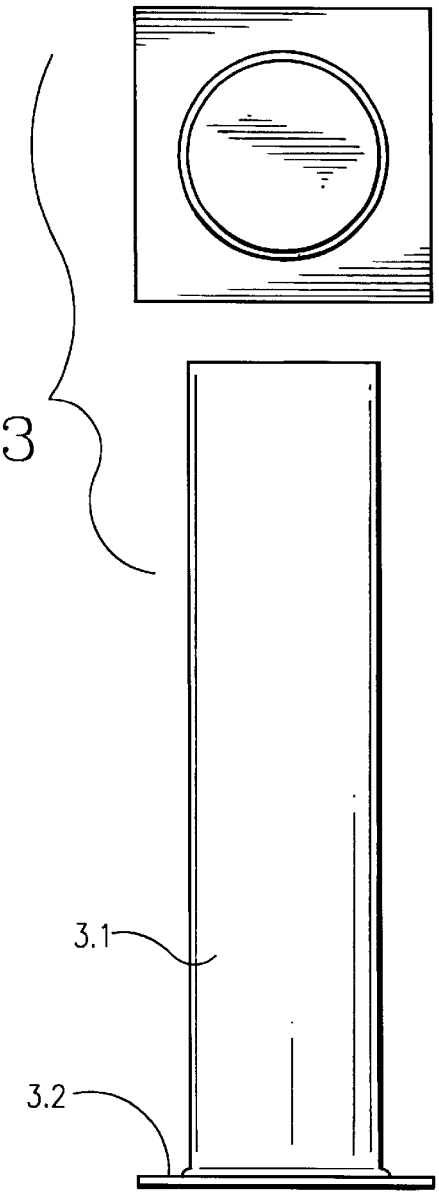

According to FIG. 2, once the roll of cable 2.7 is wound, it is packed with bending straps 2.6 hooped at four points equidistantly located at 900 from each other as shown in FIG. 2. Once hooped, the rolls of automotive cables, are concentrically inserted to a post 3.1 at the ring cut 2.4, now opened wider when the internal section assumed the vertical position. The second module comprises the post 3.1, supported by a base 3.2 as shown in FIG. 3. The post serves as a support to compress the packed rolls and usually has a capacity to hold a maximum of seven packings. The post 3.1 is preferably made of a 2 mm. thick spiral cardboard and has an external diameter of approximately 19.8 mm. The base 3.2 is preferably made of a 4 mm. thick corrugated cardboard and has an external diameter of approximately 30 cm.

This external diameter aligns with the external diameter of the circular base 2. All the three sections or modules of the packing system are generally made of cardboard material, but other materials can be used, preferably plastic.

Figure 4:
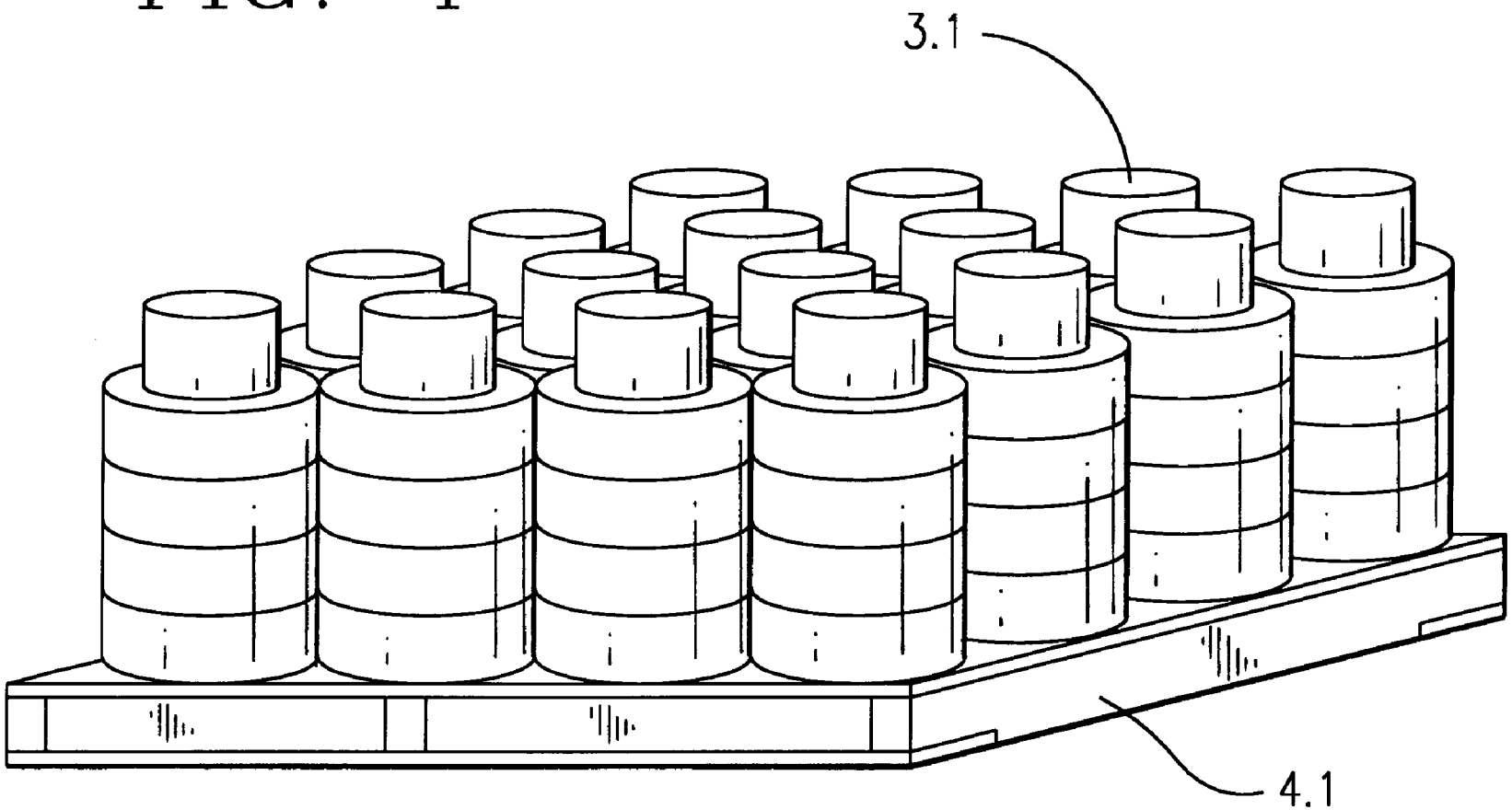
Figure 5:
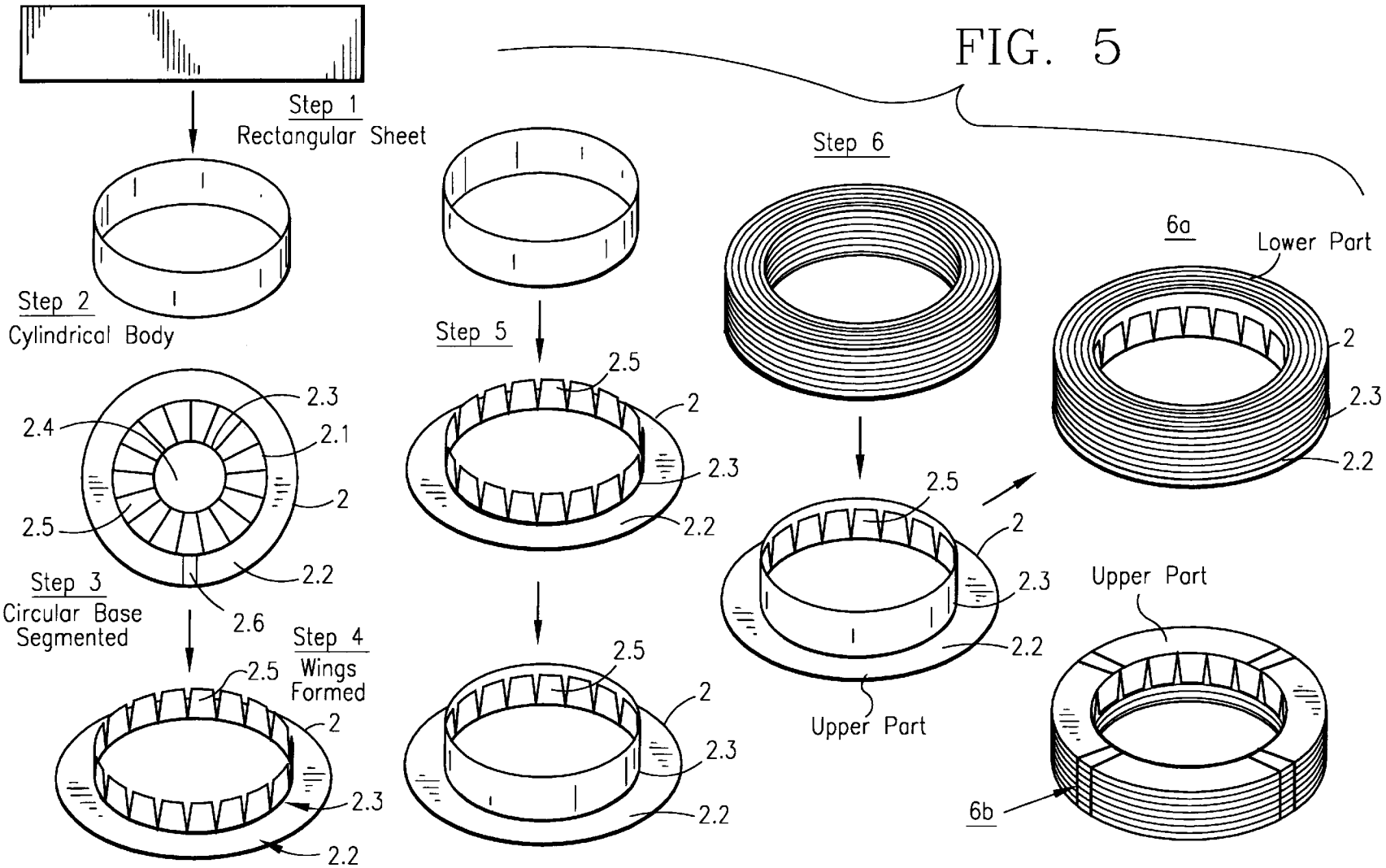
FIG. 5 shows steps 1–6*b* in the method for packing and stowing an automotive cable.
Figure 5A:
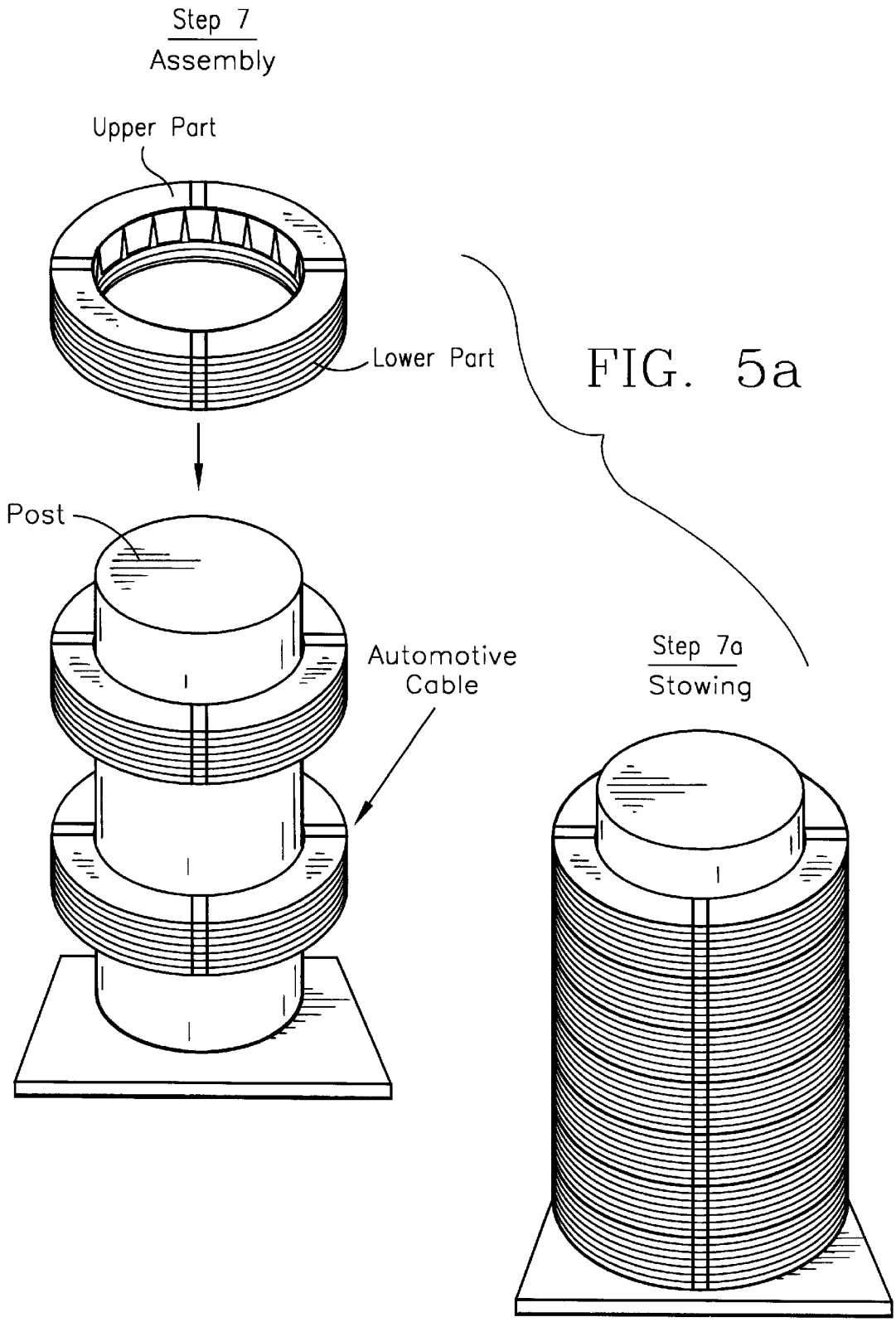
FIG. 5A shows steps 7–7*a* in the method for packing and stowing an automotive cable.

Finally, for the shipment of the packed product, the stows of rolls 2.1 stacked on the post 3.1 are set on a wooden or plastic platform 4.1 as shown in FIG. 4. These are placed in an arrangement of 4×4 for a total of 16 stows as shown in FIG. 4.

Having described the invention, it is considered as a novelty, so the following is claimed:

We claim:

1. A method for packing and stowing an automobile cable using a holder having a concentrically segmented circular base; the circular base comprising an external section drawn in a horizontal plane and an internal section having two positions, one position in plane with the external section and a second position, disposed vertically to the external section, the internal section having a central circular cut; and a cylindrical body integrated with the vertically disposed internal section of the circular base, said method comprising the steps of:

a) hooping a wound cable to form a packed roll;

b) accommodating the packed roll of cable to the holder; and c) inserting the packed roll to a post supported by a base.

2. A packing system for packing a smaller quantity of a greater variety of automotive cable to effect a reduction of cable inventory, comprising:

a circular base for each packed wound roll of cable; the circular base having an internal part comprising concentrically segmented members, an outer member permanently drawn in a horizontal plane and an inner member having two positions, one position in plane with the outer member and a second position vertically disposed to the outer member, the inner member having a central circular cut forming a circular inner edge, said inner member having transversal cuttings set equidistantly forming attachment wings, the attachment wings opening into separate tabs having gaps between them when the inner member is in second position, the tabs having a side facing the circular cut and a side facing the outer member drawn in a horizontal plane;

a solid non-perforated cylindrical body disposed on an outer circumference of the inner member at the second position to reinforce and form a solid upright, open topless cylindrical insole having the outer member of the circular base extending laterally from the peripheral bottom edge of the cylindrical body to provide stability and guidance for the automotive cable;

a post supported by a base for stowing packed wound rolls of cable, the post holding a maximum of seven-packed wound rolls of cable; and, a platform for accommodating sixteen posts of stowed packed rolls of cable.

3. The packing system of claim 2 wherein the inner member presents transversal cuttings set equidistantly disposed in its periphery forming attachment wings.

4. The packing system of claim 2 wherein the cylindrical body is formed from a rectangular sheet joined on its end.

5. The packing system of claim 2 wherein the packing system is made of a material selected from the group consisting of cardboard and plastic.

6. The packing system of claim 2 wherein the cylindrical body peripherally wrap around a center of the packed wound roll of cable.

7. The packing system of claim 2 wherein the platform is made of a material selected from the group consisting of wood and plastic.

8. The packing system of claim 2 wherein the internal section is disposed 90° to the external section before accommodating the packed wound roll of cable.

9. A method for packing and stowing an automobile cable, comprising the steps of a) winding a cable;

b) hooping a wound cable forming a packed roll of cable;

c) providing a packing and stowing system comprising a circular base; the circular base having an internal part comprising concentrically segmented members, an outer member permanently drawn in a horizontal plane and an inner member having two positions, one position in plane with the outer member and a second position vertically disposed to the outer member, the inner member having a central circular cut, a side facing the circular cut and a side facing the outer member drawn in a horizontal plane;

a solid non-perforated cylindrical body disposed on an outer circumference of the inner member at the second position to reinforce and form an upright, open topless cylindrical insole having the outer member of the circular base extending laterally from a peripheral bottom edge of the cylindrical body to provide stability and guidance for the automotive cable;

a post supported by a base for stowing packed wound rolls of cable, the post holding a maximum of seven-packed wound rolls of cable; and, a platform for accommodating sixteen posts of stowed packed rolls of cable, d) inserting the circular base to a conventional bobbin thereby opening the internal section to a position vertically disposed relative to the outer member;

e) integrating a cylindrical body to the vertically disposed inner member of the circular base;

f) accommodating the packed roll of cable on the vertically disposed internal section of the circular base integrated with the cylindrical body;

g) inserting the hooped packed cable to the post having a base support; and, h) setting the post having the packed cable on the platform.

10. The method of claim 9 wherein the post has a capacity of receiving at least seven packed rolls of cable.

11. The method of claim 9 wherein the platform accommodates at least sixteen stowed packed rolls of cable.

* * * * *